US007540263B2

(12) United States Patent
Cerreto

(10) Patent No.: US 7,540,263 B2
(45) Date of Patent: Jun. 2, 2009

(54) FUEL INJECTION SYSTEM FOR TWO-STROKE INTERNAL COMBUSTION ENGINES

(75) Inventor: Nicola Cerreto, Bagnolo In Piano (IT)

(73) Assignee: EMAK S.p.A., Bagnolo In Piano (Reggio Emilia) (IT)

( * ) Notice: Subject to any disclaimer, the term of this patent is extended or adjusted under 35 U.S.C. 154(b) by 0 days.

(21) Appl. No.: 11/817,375

(22) PCT Filed: Feb. 9, 2006

(86) PCT No.: PCT/EP2006/001316

§ 371 (c)(1),
(2), (4) Date: Aug. 29, 2007

(87) PCT Pub. No.: WO2006/094603

PCT Pub. Date: Sep. 14, 2006

(65) Prior Publication Data

US 2008/0156306 A1 Jul. 3, 2008

(30) Foreign Application Priority Data

Mar. 7, 2005 (IT) ..... RE2005A0018

(51) Int. Cl.
*F02B 25/00* (2006.01)
*F02M 69/10* (2006.01)

(52) U.S. Cl. ..... 123/73 A; 123/73 C

(58) Field of Classification Search ..... 123/73 R, 123/73 A, 73 C, 73 PP, 74 R
See application file for complete search history.

(56) References Cited

U.S. PATENT DOCUMENTS

| | | | | |
|---|---|---|---|---|
| 6,601,550 | B2 * | 8/2003 | Geyer et al. | 123/73 PP |
| 2001/0032601 | A1 | 10/2001 | Galka et al. | |
| 2002/0139326 | A1 | 10/2002 | Araki | |
| 2004/0040522 | A1 | 3/2004 | Mavinahally et al. | |

FOREIGN PATENT DOCUMENTS

WO 200011334 A1 3/2000

* cited by examiner

*Primary Examiner*—Noah Kamen
(74) *Attorney, Agent, or Firm*—Browdy and Neimark, P.L.L.C.

(57) ABSTRACT

A fuel injection system for a two-stroke internal combustion engine (1) elastically housed in a compartment and comprising a carburettor (30) with which there are associated an induction port (9) for the air/fuel mixture and a fuel feed conduit (10) intercepted by dispenser means fixed to a fuel accumulation system (25) communicating with a first aperture (14) positioned below the induction port (9) and with a second aperture (15) positioned above the induction port (9), said apertures (14, 15) being alternately opened by the skirt of the piston (3), said system comprising a non heat-conducting elastic intake header (22) positioned between the carburettor (30) fixed to the wall (40) of the compartment housing the engine (1) and the feel dispenser means fixed to the fuel accumulation system (25).

12 Claims, 10 Drawing Sheets

FUEL INJECTION SYSTEM FOR TWO-STROKE INTERNAL COMBUSTION ENGINES

TECHNICAL FIELD

The present invention relates to a fuel injection system for two-stroke internal combustion engines.

PRIOR ART

From WO 00/11334 two-stroke internal combustion engines are known comprising a crankcase and a cylinder connected to the crankcase. The induction port opens into the region between the cylinder base and the crankcase, and originates from the carburetor which feeds a "weak" mixture, i.e. with air in excess of stoichiometric, the purpose of which is to lubricate the crankcase crank mechanisms and provide combustion air. A reciprocating piston is located within the cylinder to draw the weak mixture into the crankcase during its rise, and to transfer said mixture to the cylinder through a transfer conduit between the crankcase and cylinder during its descent. At least one exhaust port is present in front of the induction port.

An injection system is provided comprising a fuel intake conduit which feeds an accumulation system comprising an accumulation conduit presenting a first aperture and a second aperture which communicate with the cylinder respectively below and above the port for mixture induction into the cylinder. The piston skirt successively opens and closes the two apertures while the piston moves with reciprocating movement within the cylinder.

Before its injection into the cylinder through the second aperture, the fuel accumulates within the accumulation system, from which it is injected into the cylinder by a pressure wave generated by the explosion of the mixture within the cylinder. The pressure wave penetrates into the accumulation conduit via the second aperture and passes along it as far as the first aperture, which is blocked by the piston skirt. From there it rises along the conduit to entrain the fuel, which is hence injected into the cylinder. The fuel is usually injected into the cylinder when the piston is at or slightly before its bottom dead centre and with the first aperture blocked.

To inject the correct fuel quantity into the cylinder, the quantity accumulated in the accumulator must be suitably metered before injection into the cylinder.

To achieve this, controlled metering devices are used consisting generally is of an electronic dispenser for the fuel originating from the carburetor. Said electronic dispenser must be highly accurate in terms both of time and quantity, and is not only of highly sophisticated construction but is also very bulky.

Moreover, as the carburetor must be maintained at a temperature substantially less than the temperature in the engine compartment, said carburetor is located outside the engine compartment at a suitable distance from the engine, to which it is connected by a header of length sufficient to disperse the heat, and also positioned outside the engine compartment.

DISCLOSURE OF THE INVENTION

The object of the present invention is to provide a fuel injection system for internal combustion engines which is provided with fuel metering means of small size and elementary operation, and can be used in portable tools having a relatively small engine housing compartment, such as pruners, mowers, chain saws, grass blowers and the like.

This object is attained by a fuel injection system for two-stroke internal combustion engines having a non heat-conductive elastic intake header positioned between the engine carburetors, fixed to the wall of the compartment housing the engine.

Preferred and particularly advantageous embodiments of the fuel injection system for two-stroke internal combustion engines are also disclosed according to the invention.

BRIEF DESCRIPTION OF THE DRAWINGS

Further characteristics and advantages of the invention will be apparent on reading the ensuing description, provided by way of non-limiting example, with reference to the figures of the accompanying drawings, in which.

BEST MODE FOR CARRYING OUT THE INVENTION

Figure 1A:
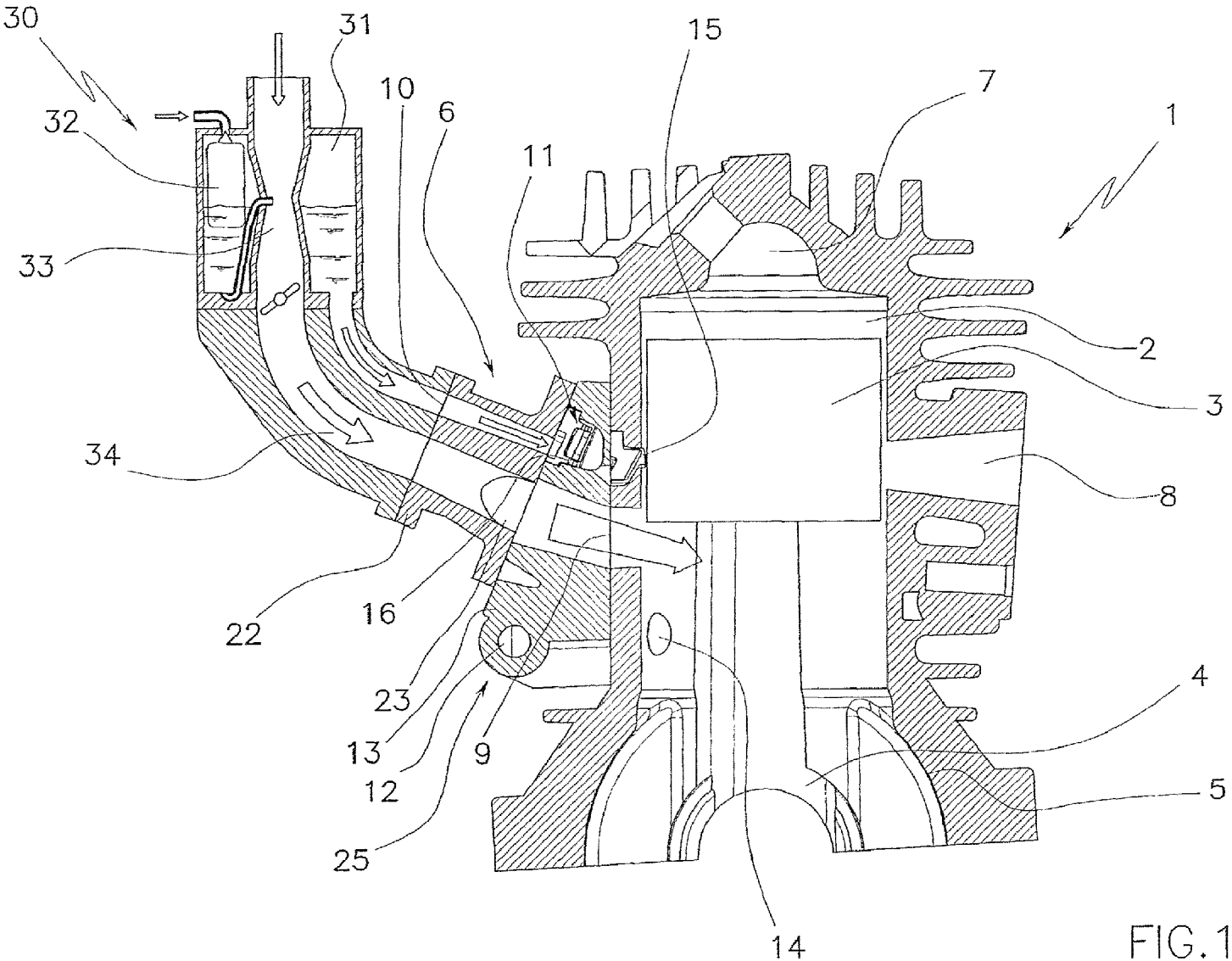
FIGS. 1A-1E schematically show an axial section through an engine incorporating a fuel injection system with the piston in different operative positions assumed during the cycle.
Figure 1B:
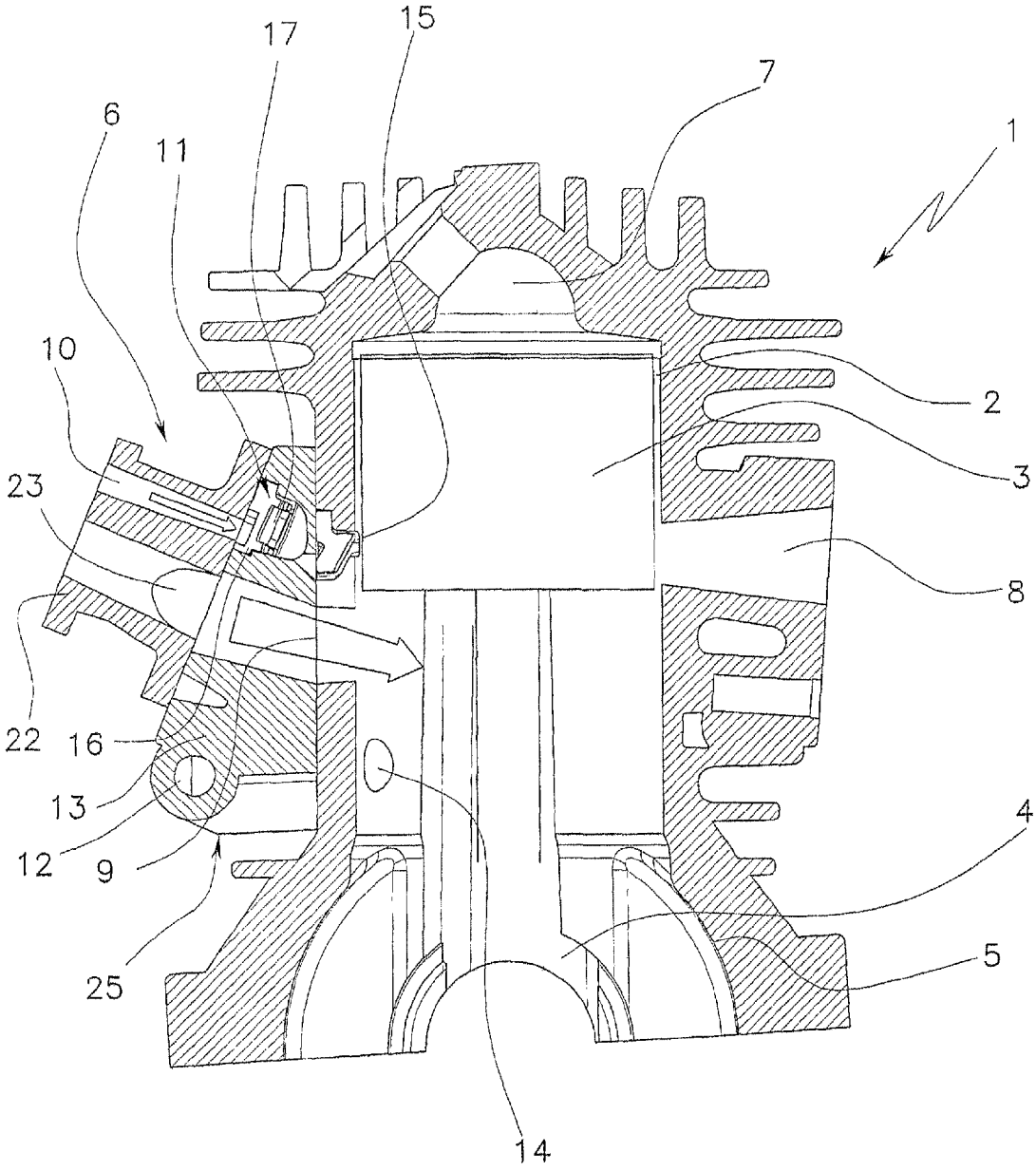
Figure 1C:
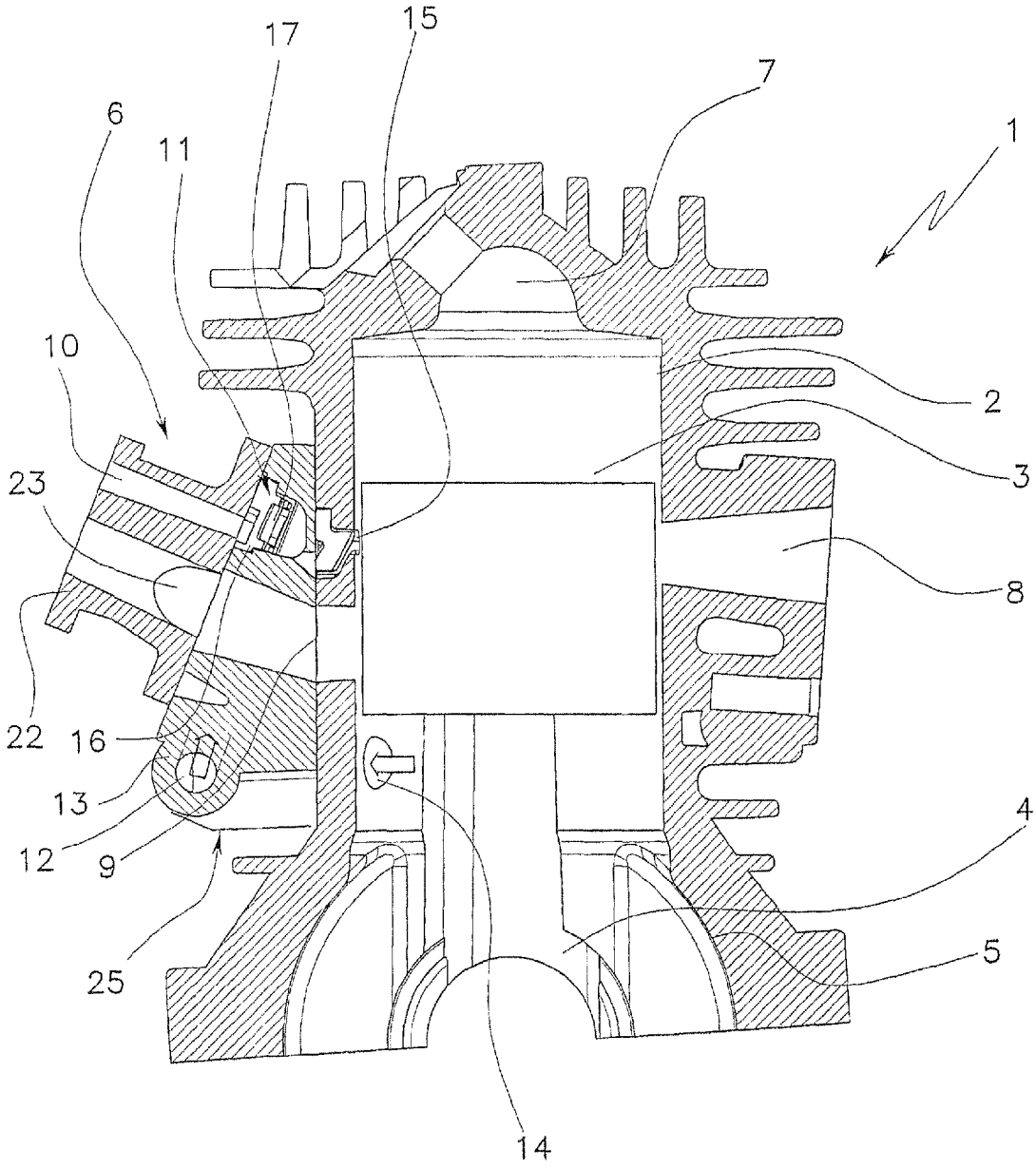

Said figures show a fuel injection system for an internal combustion engine 1 according to the present invention.

The engine 1 is a two-stroke engine comprising a cylinder 2, a piston 3, a connecting rod 4 connected to the crank, a crankcase 5, a transfer conduit 24 (FIGS. 1D, 1E) between the crankcase 5 and the cylinder 2, and a fuel injection system 6.

An ignition spark plug (not shown) is associated with the head of the cylinder 2; the lower end of the cylinder freely communicates with the crankcase 5.

The combustion chamber 7 is provided in the head. The exhaust port 8 and the air/fuel mixture induction port 9 are located opposite each other in the central part of the cylinder 2.

According to the invention, the air/fuel mixture fed to the crankcase 5 is a weak mixture, i.e. with air in excess of stoichiometric, its purpose being to lubricate in addition to supplying combustion air.

This mixture is composed of fuel which mixes in the form of minute droplets with air in a carburetor 30, shown for simplicity only in FIG. 1. The carburetor 30 is of the diaphragm type as it can operate in any position and does not spill fuel during manipulation or during transport. It comprises essentially a chamber 31 into which the fuel arrives under pressure via a conduit 32 intercepted by a needle valve 33 operated by a diaphragm 34, an air inlet conduit communicating with a suction conduit associated with the induction port 9, and a first conduit and second conduit for drawing fuel from the chamber 31 towards respectively the suction conduit and a fuel feed conduit 10 pertaining to the fuel injection system 6.

The fuel feed conduit 10 is intercepted by valving means 11, described in detail hereinafter, and communicates with an accumulation system 25 to which it is connected.

The accumulation system 25 comprises an accumulation conduit 12 communicating with a first aperture which communicates with the crankcase 5, and with a second aperture 15 which communicates with the interior of the cylinder 2, these apertures being spaced apart and located respectively below and above the mixture induction port 9.

The skirt of the piston 3 is shaped to open the first aperture 14 and second aperture 15 in succession during the rise of the piston, and vice versa during its descent.

According to the present invention, the accumulation conduit 12 also communicates with a recess 16 shaped to receive as an exact fit, in proximity to the second aperture 15, the valving means 11 which intercept the fuel feed conduit 10.

Figure 1D:
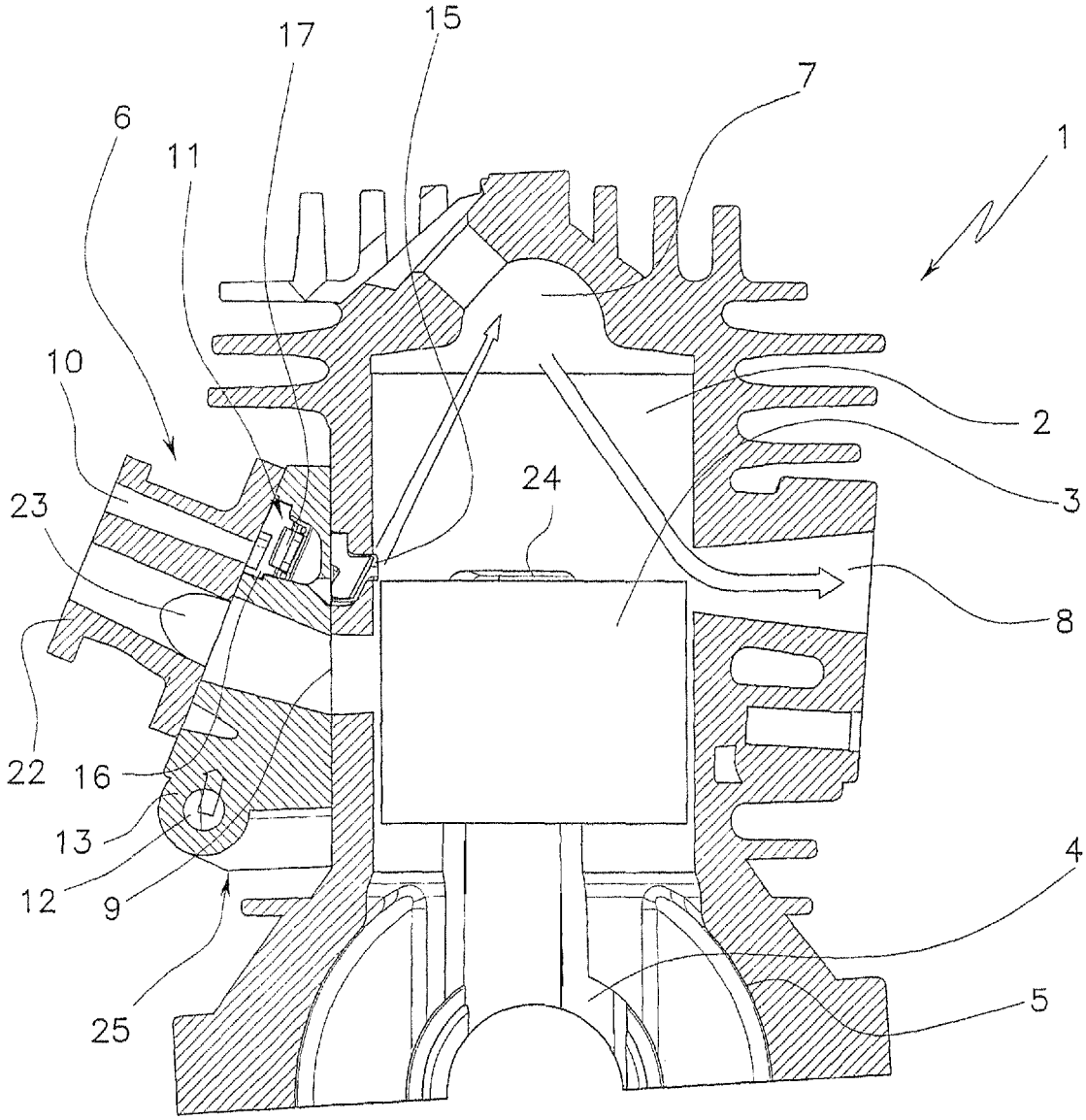
Figure 1E:
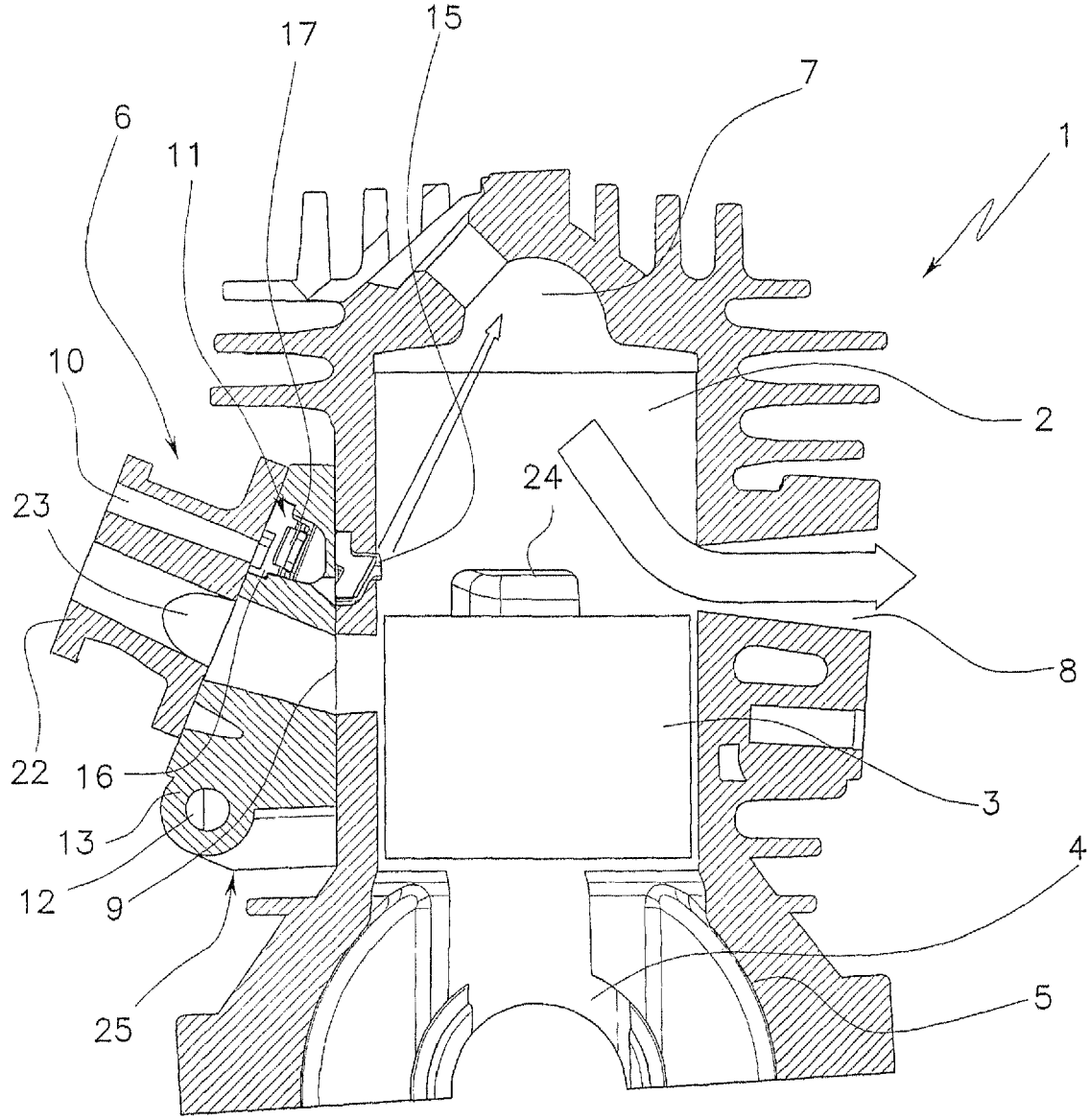
Figure 2:
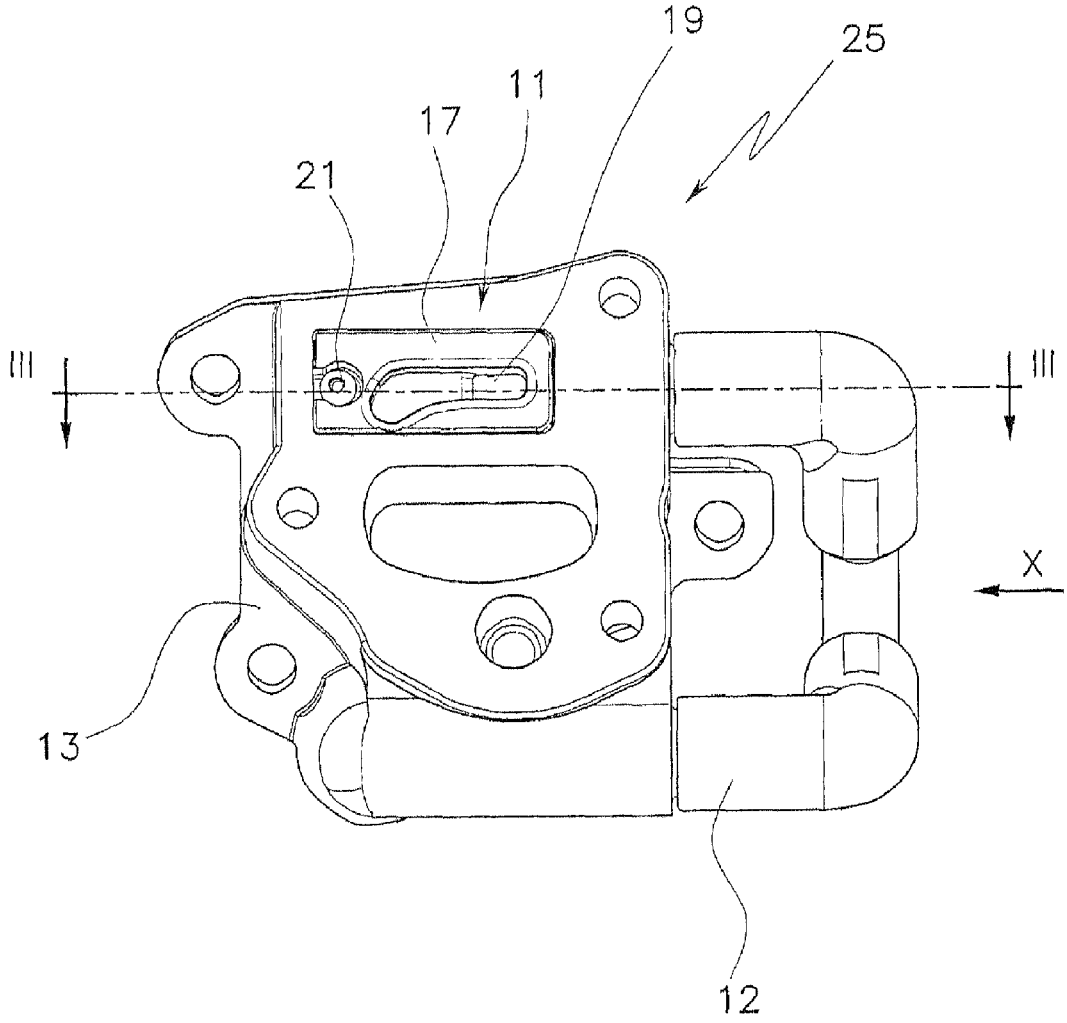
FIG. 2 shows the flange of the injection system of the present invention, seen on the carburetor side.
Figure 3:
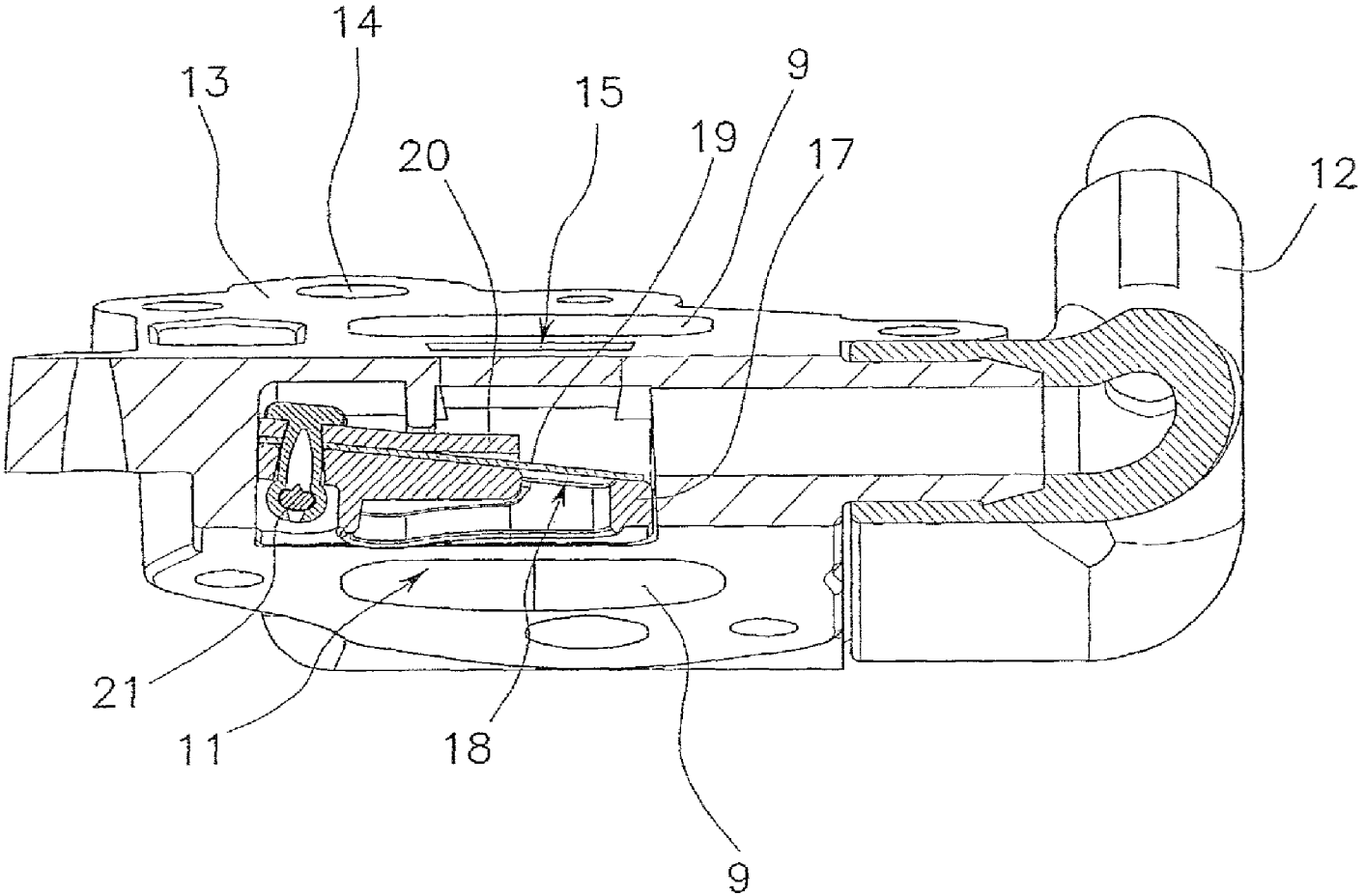
FIG. 3 is a section on the line III-III of FIG. 2.

In the embodiment shown in FIGS. 1 to 3, the accumulation conduit 12 is associated with a thermosetting resin flange 13 fixed to the engine and in which said recess 16 is provided.

A non heat-conducting header 22 sealedly fixed to the flange 13 comprises a rigid base 22*a* sealedly fixed to the flange 13, an intermediate part 22*b* of elastically deformable synthetic material and a flange 22*c* fixed between the carburetor 30 and the wall 40 of the compartment housing the engine 1, in the intermediate part 22*b* there being formed a part of the fuel feed conduit 10 and a channel 23 terminating at the air/fuel mixture induction port 9 (FIG. 1A).

According to the invention, that end 22*c* of the intermediate part of the header 22 associated with the carburetor 30 is profiled to cooperate with that portion of the wall 40 of the engine housing compartment which supports the carburetor 30, positioned outside the engine compartment (FIG. 1A).

As the header 22 is made of non heat-conducting material, it is able to thermally isolate the carburetor 30 from the engine 1, which attains high temperature during operation.

The header 22 is of small overall size such as to be able to be housed, as in the illustrated embodiment, within the compartment housing the engine 1 (FIG. 1A).

The valving means 11 are opened, to apply suction to the accumulation conduit 12 for the fuel present in the conduit 10, by the vacuum created in the conduit 12 via the first aperture 14.

The opening operation is described in detail hereinafter.

According to the preferred embodiment of the present invention shown in FIGS. 1 to 3, the valving means 11 comprise a valve body 17 provided with a passage 18 and a flexible blade 19 for closing this passage 18 in the direction of the conduit 10 (FIG. 3).

In the embodiment of FIGS. 1 to 3, the flexible blade 19 is made of metal and is fixed at one end to the valve body 17, to peripherally abut against the valve body 17.

However any other material can be used for the blade 19, provided it is flexible.

Essentially, the flexible blade 19 can flex only on one side as the peripheral portion abutting against the valve body 17 prevents the flexible blade 19 from flexing in the other direction.

In the example, flexure takes place towards the interior of the accumulation conduit 12.

On that side facing the fuel feed conduit 10, the flexible blade 19 is constantly wetted by the fuel which is isolated from the accumulation conduit 12 when the blade is in its closure position.

Consequently the first and second aperture 14, 15 communicate with each other via the accumulation conduit 12 even when the flexible blade 19 is in its closure position.

According to the present invention, the fuel present in the fuel feed conduit 10, and which wets the flexible blade 19, passes through the passage 18 in the valve body 17 when, on that side of the flexible blade 19 opposite that wetted by the fuel, a vacuum is created sufficient for the flexible blade 19 to flex and open the passage 18 (FIG. 3).

Essentially, the valving means 11 are opened simply by the difference in the pressures exerted on the opposing sides of the flexible blade 19.

Consequently, the choice of material and thickness of the flexible blade 19 is made on the basis of the desired degree of opening for a given vacuum present on the side facing the accumulation conduit 12.

Suitable means for limiting the opening of the blade 19 can be provided, such as a rigid strip 20 fixed at one end to the valve body 17 to limit the angle of opening of the blade 19 (FIG. 3).

As shown in FIGS. 2 and 3, both the flexible blade 19 and the rigid strip 20 are fixed to the valve body 17 by a common fixing means such as a rivet 21.

The operation of the two-stroke engine is as follows, with reference to FIGS. 1A to 1E:

- a compression stage (FIG. 1A), in which the piston 3 rises as far as its top dead centre, during which it opens the first aperture 14 and the induction port 9, and closes the second aperture 15 and the exhaust port 8. During the rise starting from the bottom dead centre, the pressure in the crankcase 5 falls below atmospheric. Hence when the first aperture 14 is opened, not only is the pressure present in the accumulation conduit 12 released, but a vacuum is created. This vacuum opens the flexible blade 19 and draws fuel from the conduit 10 and into the accumulation conduit 12; immediately after this, during the rise the induction port 9 is also opened, through which new weak mixture is drawn;
- a combustion stage (FIG. 1B), in which when the piston 3 is close to its top dead centre, a spark in the combustion chamber 7 ignites the fuel/air mixture which has been compressed above the piston 3. The pressure in the crankcase 5 and the pressure in the accumulation conduit 12 at the second aperture 15 do not change as the flexible blade 19 is closed by elastic return aided by the combustion pressure, The combustion in the combustion chamber 7 causes the gases to expand, to urge the piston 3 downwards;
- an expansion stage (FIG. 1C), in which the piston 3 descends to close the exit aperture 15, the exhaust port and the induction port 9, whereas the entry aperture 14 is opened. The previously indrawn weak mixture is compressed within the crankcase 5 and, via the first aperture 14, also in the accumulation conduit 12 where fuel is already present;
- an exhaust stage (FIG. 1D), in which while continuing to descend the piston 3 opens the exhaust port 8, then during descent it closes the induction port 9 and the first aperture 14, whereas it opens the second aperture 15; while the high pressure exhaust gases are being expelled from the exhaust aperture 8, they transfer part of their energy into the accumulation conduit 12 via the second aperture 15 in the form of a pressure wave; the mixture also commences transfer from the crankcase 5 to the combustion chamber 7 through the transfer conduit 24;
- an injection stage (FIG. 1E), in which the piston 3 rises from its bottom dead centre, to close the induction port 9 and the first aperture 14. The pressure wave trapped in the accumulation conduit 12 reaches the opposite end corresponding to the closed first aperture 14, turns back and entrains with it the fuel accumulated in the accumulation conduit 12, which is injected at high speed into the combustion chamber 7 to repeat the combustion stage, and so on. When the fuel is injected, the pressure in the combustion chamber 7 is close to atmospheric.

By virtue of the pressure wave which injects the fuel at high speed, this latter undergoes atomization which improves the engine efficiency and consequently fuel consumption, hence minimizing consumption and reducing pollution due to scavenging losses.

The fuel can be injected along a desired direction by suitably shaping the second aperture 15.

As stated, the flange 13 is made of thermosetting resin.

In the embodiment of FIGS. 3 to 6, the flange 13 is made of aluminum, a material which has proved particularly convenient because of its thermal capacity which facilitates attainment of the working temperature within a much shorter time than with thermosetting resin.

In this respect, it has been found that with an aluminum flange 23, the working temperature of 60° C. is attained in about 10 seconds, against about the 120 seconds required with thermosetting resin.

The use of an aluminum flange results in a considerable constructional simplification in that the entire valve 11, namely the valve seat 17, the flexible blade 19 and the rigid strip 20, can be fixed directly onto the rubber header 22 instead of onto the flange 13.

In this case the header 22 comprises, at that end in contact with the flange 13, a strengthening plate 22*d* (visible in FIG. 5) incorporated into the rubber part.

Figure 4:
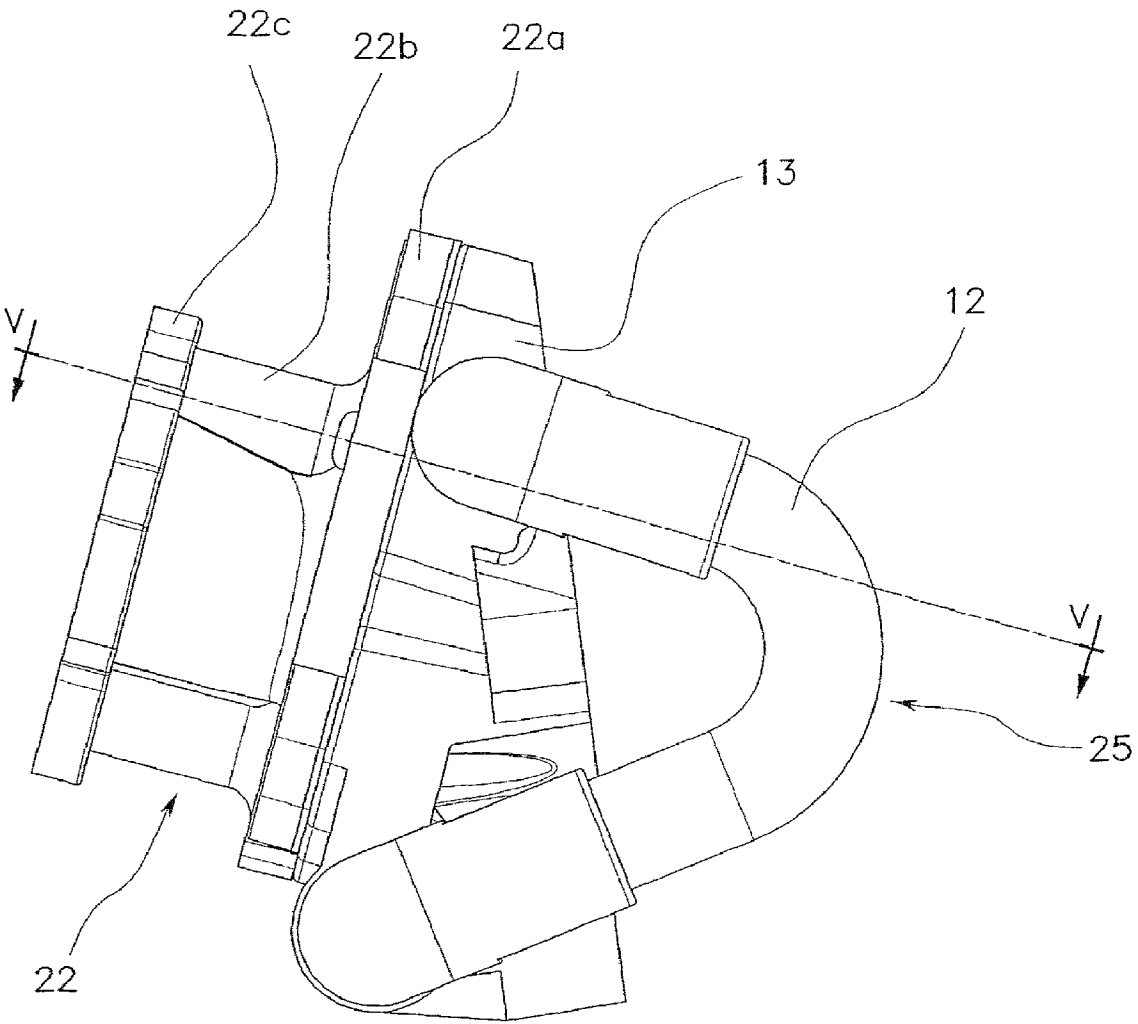
FIG. 4 shows the view from IV of FIG. 2.
Figure 5:
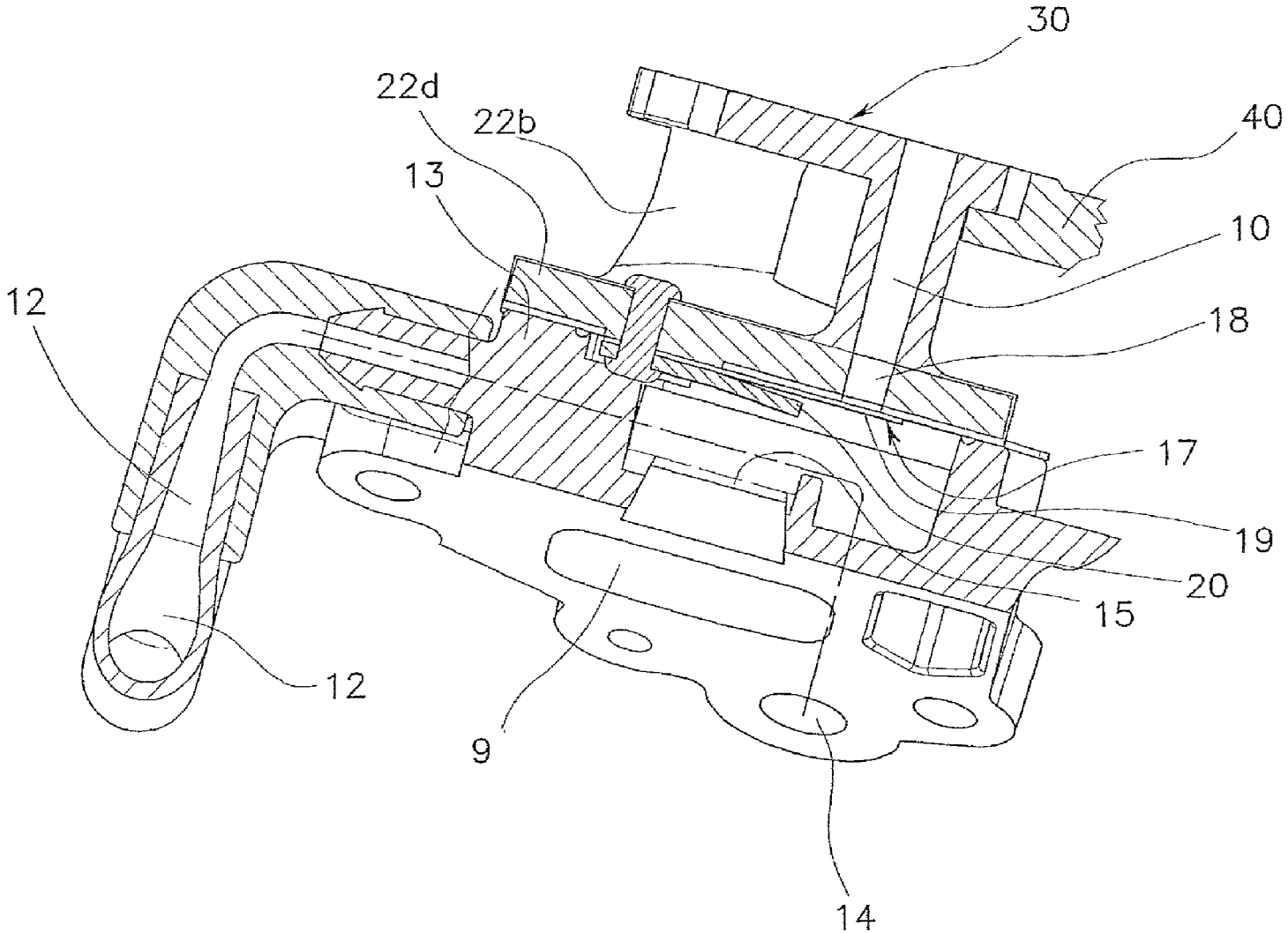
FIG. 5 shows the section V-V of FIG. 4.
Figure 6:
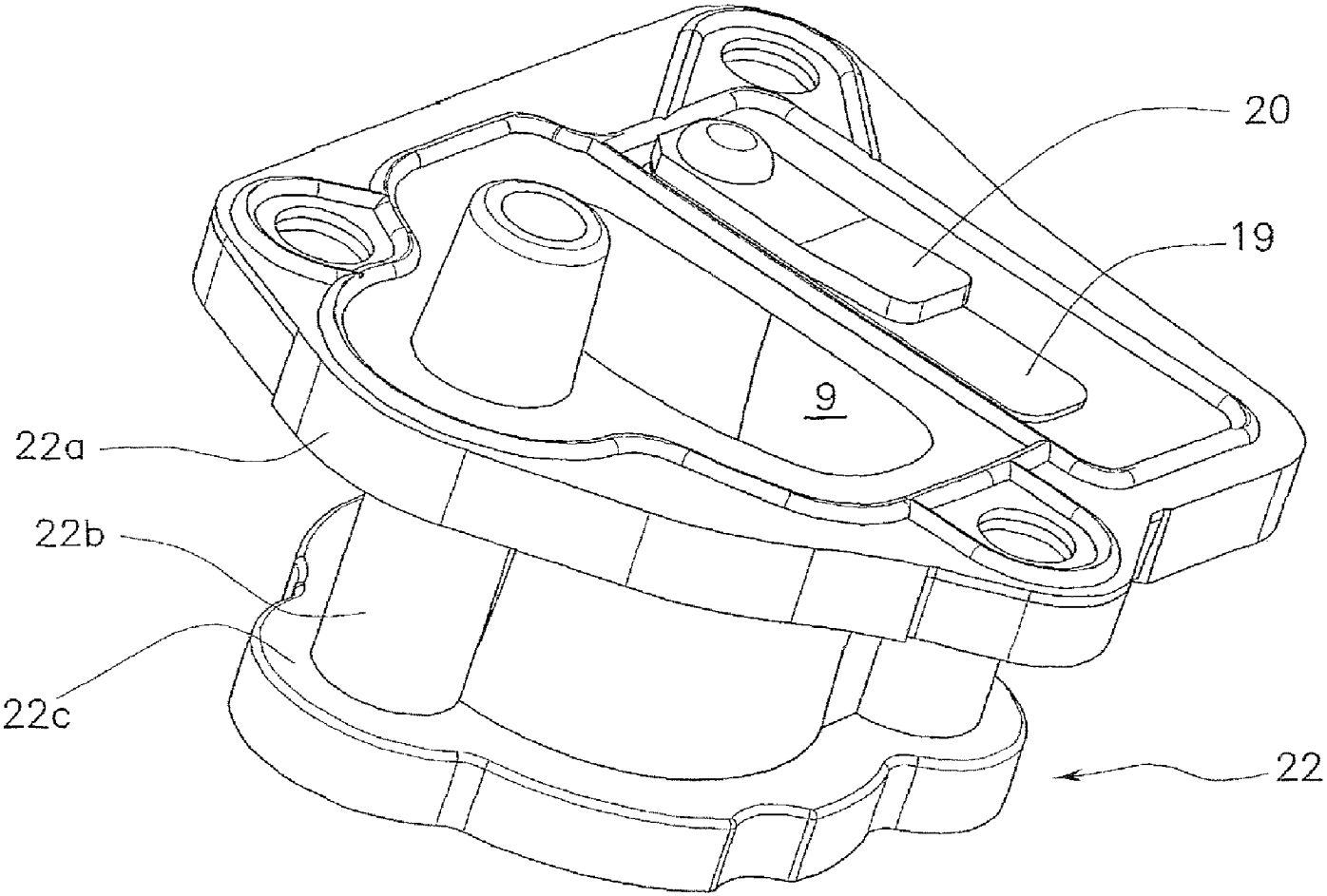
FIG. 6 is a perspective view of the intake header.

With particular reference to the embodiment shown in FIGS. 4 to 6, in which the same reference numerals are used for parts corresponding to those of FIGS. 1 to 3, the plate 22*d* can be seen incorporated into the base of the rubber header 22, and traversed by the passage 18 which in FIG. 3 was located in the body of the flange 13, and which now enables the fuel to reach the port 15 through which it is fed into the cylinder.

FIG. 5 also shows the induction port 9, the accumulation conduit 12 and the hole 14 by which it opens into the cylinder via a passage indicated by dashed lines in the figure, and extending within the flange 13 in a plane different from the section plane.

As can be appreciated from the description, the fuel injection system for an internal combustion engine according to the present invention satisfies the requirements and overcomes the drawbacks of the known art stated in the introduction to the description.

In this respect, the fuel injection system for an internal combustion engine according to the present invention presents valving means of elementary construction which do not require any maintenance during normal use, are extremely simple and are activated directly by the vacuum which forms in the accumulation conduit, to provide a guaranteed fed fuel quantity and an operating time comparable with that of the most sophisticated electronic dispensing systems of the known art.

In addition, the non heat-conducting intake header according to the invention can be totally housed within the engine compartment to further reduce overall space requirements.

An expert of the art can apply numerous modifications and variants to the aforedescribed internal combustion engine fuel injection system to satisfy specific contingent requirements, all of which however are contained within the scope of protection of the invention, as defined by the following claims.

The invention claimed is:

1. A fuel injection system for a two-stroke internal combustion engine (1) elastically housed in a compartment and comprising a carburettor (30) with which there are associated an induction port (9) for the air/fuel mixture and dispenser means fixed to a fuel accumulation system (25) communicating with a first aperture (14) positioned below the induction port (9) and with a second aperture (15) positioned above the induction port (9), said apertures (14, 15) being alternately opened by the skirt of the piston (3), characterised by the fact of comprising a non heat-conducting elastic intake header (22) positioned between the carburettor (30) fixed to the wall (40) of the compartment housing the engine (1) and the fuel dispenser means connected to the fuel accumulation system (25), said heat-conducting elastic intake header (22) comprising a part of a fuel feed conduit (10) intercepted by said dispenser means, and a channel (23) in fluid communication with said induction port (9).

2. An injection system as claimed in claim 1, wherein said header (22) comprises a rigid base (22*a*) sealedly fixed to a flange (13) for connection to the engine, an intermediate part (22*b*) of elastically deformable synthetic material and a flange (22*c*) fixed between the carburettor (30) and the wall (40) of the compartment housing the engine (1), in the intermediate part (22*b*) there being formed a part of the fuel feed conduit (10) and a channel (23) terminating at the air/fuel mixture induction port (9) via said dispenser means and aid flange (13).

3. An injection system as claimed in claim 2, wherein said flange (13) is provided with holes communicating with said first aperture (14) and second aperture (15), at which the accumulation system (25) terminates.

4. An injection system as claimed in claim 2, wherein said dispenser means comprise within the flange (13) a recess (16) shaped to house as an exact fit valving means (11) positioned between the accumulation system (25) and the fuel feed conduit (10), said valving means (11) being opened directly by a vacuum perceivable at said second aperture (15), by which the fuel is drawn from the fuel feed conduit (10) and into the accumulation system (25).

5. An injection system as claimed in claim 4, wherein said valving means (11) comprise a valve body (17) provided with a passage (18) and a flexible blade (19) arranged to close said passage (18) in the direction of the accumulation system (25).

6. An injection system as claimed in claim 5, wherein said flexible blade (19) is fixed at one end to the valve body (17).

7. An injection system as claimed in claim 5, wherein said valving means (11) further comprise means (20) for limiting the opening of said flexible blade (19).

8. An injection system as claimed in claim 7, wherein said opening limiting means comprise a rigid strip (20) fixed at one end to the valve body (17).

9. An injection system as claimed in claim 5, characterised in that said flexible blade (19) is fixed to the header (22).

10. An injection system as claimed in claim 5, characterised in that said fixed strip (20) is fixed to the header (22).

11. An injection system as claimed in claim 1, wherein said second aperture (15) is shaped such as to inject the fuel into the cylinder (2) along a predetermined direction.

12. An injection system as claimed in claim 1, wherein the flange (13) is of aluminium.

* * * * *